US006431105B2

(12) United States Patent
Haram

(10) Patent No.: US 6,431,105 B2
(45) Date of Patent: Aug. 13, 2002

(54) METHOD FOR BRINGING PEOPLE IN LIFE BOATS ABOARD A SUPPORT VESSEL AND A SUPPORT VESSEL

(75) Inventor: Per Haram, Hafrsfjord (NO)

(73) Assignee: Simon Mokster Shipping AS, Stavanger (NO)

( * ) Notice: Subject to any disclaimer, the term of this patent is extended or adjusted under 35 U.S.C. 154(b) by 0 days.

(21) Appl. No.: 09/725,111

(22) Filed: Nov. 29, 2000

(30) Foreign Application Priority Data

Nov. 30, 1999 (NO) ..... 995861

(51) Int. Cl.[7] ..... B63B 35/40; B63B 23/00

(52) U.S. Cl. ..... 114/259; 114/201 R; 114/254; 114/365

(58) Field of Search ..... 441/80, 84; 114/60, 114/258, 259, 365, 253, 254, 348, 349, 260, 262, 45, 201 R, 362

(56) References Cited

U.S. PATENT DOCUMENTS 1,403,362 A * 1/1922 Walters ..... 441/84
2,347,412 A * 4/1944 Higgins ..... 114/259
2,370,916 A * 3/1945 Reedy, Sr. ..... 104/135
2,886,228 A * 5/1959 Susikari ..... 114/362
3,511,205 A * 5/1970 Nordh ..... 114/201 R
3,734,046 A * 5/1973 Schmidt et al. ..... 114/259
3,865,062 A * 2/1975 Babb ..... 114/259
3,943,875 A * 3/1976 Sanders ..... 114/244

FOREIGN PATENT DOCUMENTS

GB 2 279 045 A * 12/1994

* cited by examiner

*Primary Examiner*—Sherman Basinger
(74) *Attorney, Agent, or Firm*—Jacobson Holman, PLLC

(57) ABSTRACT

A method for bringing people in life boats in the sea aboard a support vessel, in which a rescue craft is launched from a ramp in the stern of the support vessel. The rescue craft carrying a rope from a winch in front of the ramp. The rope is attached to a life boat in the sea. The life boat is hauled onto the ramp by the winch and the life boat is emptied. A support vessel for launching and recovery of rescue crafts and life boats including a stern ramp for launching and entering of rescue crafts and life boats and a winch for hauling the rescue crafts and life boats onto the ramp.

17 Claims, 12 Drawing Sheets

METHOD FOR BRINGING PEOPLE IN LIFE BOATS ABOARD A SUPPORT VESSEL AND A SUPPORT VESSEL

FIELD OF THE INVENTION

The invention relates to a method for bringing people in life boats in the sea aboard a support vessel.

The invention also relates to a support vessel for launching and recovery of rescue crafts and life boats.

BACKGROUND OF THE INVENTION

Some marine operations and installations are supported by a support vessel. The support vessel may provide fuel supply, radio communication, operational control and helicopter landing and fuelling facilities.

A particular purpose of a support vessel is to rescue people from life boats. In calm weather this is straightforward, and can be done by ladders, or by baskets hanging from a crane on the support vessel. In bad weather, however, both the use of ladders and baskets are endangered by the waves and the wind, and bringing people from a life boat to a support vessel is a risky operation.

Another purpose of a support vessel is rescue of personnel from the sea. For this purpose the support vessel may carry one or more rescue craft, with room for e.g. 20 persons. Rescue crafts are conventionally carried in davits or cribs, and are launched and recovered by cranes on the support vessel. In calm weather both launching and recovery of a rescue craft by a crane is straightforward. In bad weather, however, these lifting operations are risky, and can hardly be carried out.

A particular use of a support vessel is as a stand by vessel for one ore more oil platforms at an offshore field. North Sea offshore platforms normally have free fall lifeboats, i.e. closed life boats which are located on the platform, typically 30 meters above the sea surface. In an emergency situation these life boats are filled with personnel, and launched by a free fall. Free fall life boats have a small engine which can bring the life boat away from the oil platform. A free fall life boat is, however, both due to small engine power and small internal space, not suitable for long time use.

In bad weather significant wave height, i.e. the average height of the highest ⅓ of the waves in a certain time period, e.g. one hour, can be 10 meters in the North Sea. Bringing people from a life boat to a support vessel is then not straight-forward, as discussed above. One way of transferring people is to use a helicopter, lifting one person at a time. An oil platform may have a crew of 100–200 persons, seated in e.g. four life boats, and thus bringing all people in safety by a single or maybe two helicopters is slow. Further, in addition to being time consuming, helicopter lifting and transport are risky in bad weather. Another way of rescuing the people is to tow the life boats ashore, which is also time consuming in the North Sea, as the distance to shore my be e.g. 200 km,

SUMMARY OF THE INVENTION

The object of the invention is thus to provide a method for bringing people in life boats in the sea aboard a support vessel, which method shall be quicker and safer in bad weather than conventional methods.

The object is further to provide a support vessel for launching and recovery of rescue crafts and life boats, which launching and recovery shall be possible in bad weather.

The objects are achieved by a method and a support vessel as mentioned in the preamble, which are characterised by the features of the claims.

Thus the invention relates to a method for bringing people in life boats in the sea aboard a support vessel, in which a rescue craft is launched from a ramp in the stern of the support vessel, the rescue craft carrying a rope from a winch in front of the ramp, the rope is attached to a life boat in the sea, the life boat is hauled onto the ramp by the winch, and the life boat is emptied.

In a preferred embodiment, when bringing people from more than one life boat aboard the support vessel, the first, empty life boat is marked and returned to the sea. The rope from the winch is released from the empty life boat and picked up by the rescue craft, and attached to a second life boat in the sea. The second life boat is hauled onto the ramp, and emptied. The second, empty life boat is also marked, and returned to the sea, and in this way all life boats are brought onto the ramp and emptied.

The people in the life boats are thus brought aboard the support vessel in a quicker way than in conventional methods. Further this way of bringing people aboard the support vessel does not involve the use of a crane, and can be carried out in bad weather.

The support vessel for launching and recovery of rescue crafts and life boats according to the invention comprises a stern ramp for launching and entering of rescue crafts and life boats and a winch for hauling the rescue crafts and life boats onto the ramp.

Preferably the ramp slopes astern towards the sea, and has a V-shape for supporting the rescue crafts and the life boats. Further the ramp is preferably perforated, to dampen waves of the sea The ramp may be supported by vertical, perforated baffles extending transverse to the support vessel's longitudinal direction, to dampen motion of the sea underneath the ramp.

The support vessel is preferably provided with a rounded fender portion on each side of the ramp, besides or astern the ramp, to facilitate the entering of the rescue crafts and the life boats.

Preferably the ramp forms a part of an enclosed reception area with a closable entrance hatch for the launching and entering of the rescue crafts and life boats.

The support vessel preferably comprises at least one hatch cover which in the front is hinged to the support vessel underneath the entrance hatch, which hatch cover in a raised position closes at least a part of the entrance hatch and in a lowered position forms an extension of the ramp in the sea.

The rescue craft is preferably kept in place on the ramp by at least one locking arm on each side of the ramp. For adaption to different life boat shapes, the locking arm may be hinged in a lower end and in an upper movable end having a convex portion pointing towards the rescue craft or life boat.

The support vessel is thus feasible for launching and recovery of rescue crafts and life boats without the use of a crane, and the launching and recovery can be carried out in bad weather.

Other objects, embodiments and advantages of the invention will appear from the detailed part of the description.

BRIEF DESCRIPTION OF THE DRAWINGS

The invention will now be explained in closer detail with reference to the enclosed drawings, in which.

DETAILED DESCRIPTION OF THE PREFERRED EMBODIMENTS

The method according to the invention can be used in heavy sea, in strong wind and high waves. For illustrative purposes, FIGS. 1–8 illustrates the method according to the invention in calm sea.

Figure 1:
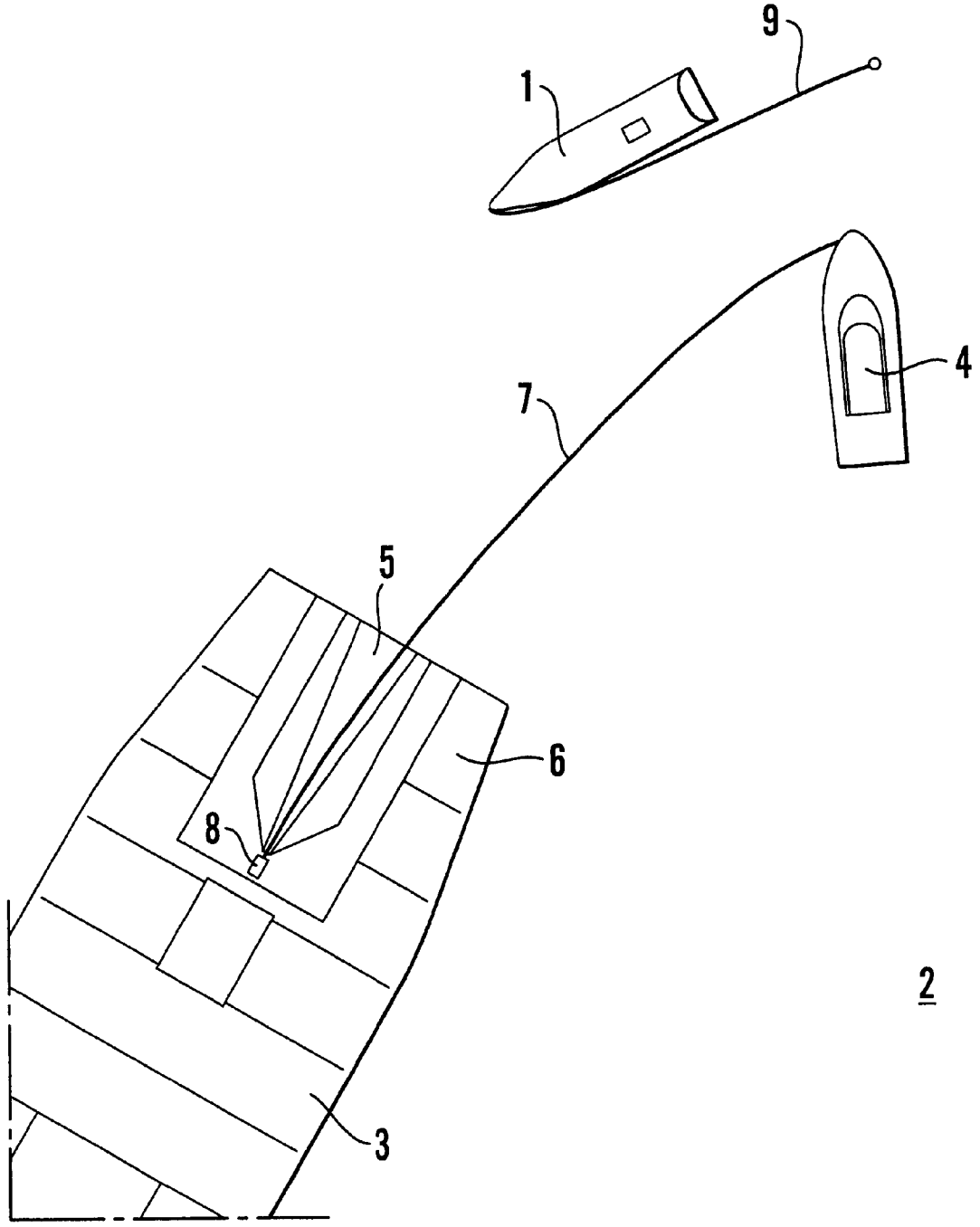
FIGS. 1–8 are perspective views illustrating various steps of the method according to the invention.

FIG. 1 illustrates a support vessel 3, a rescue craft 4 and a life boat 1 in the sea 2. The support vessel 3 is designed to support marine operations and installations, and is equipped with e.g. a control and communication centre and diesel supply tanks. according to requirements. A particular purpose of the support vessel 3 is to rescue people in an emergency situation, and for this purpose the support vessel 3 carries the rescue craft 4. In normal operation, when no emergency exist, the rescue craft 4 is located on a ramp 5 in the stern 6 of the support vessel 3. The rescue craft is fast and able to operate in heavy sea. Preferably the rescue craft is water jet propelled, as this enables entering the ramp 5 without any damaging of the propulsion system.

The illustrated life boat 1 is a free fall life boat which has been launched from an oil platform (not illustrated) and which carries e.g. 70 persons. A rope 9 which was fixed to the bow of the life boat 1 prior to the launch of the life boat from the oil platform floats in the sea.

The task which is solved by the method according to the invention is to bring the people in the life boat aboard the support vessel 3.

In the method according to the invention, the rescue craft 4 is launched from the ramp 5. The rescue craft 4 carries a rope 7 from a winch 8 in front of the ramp 5, as illustrated in FIG. 1.

Figure 2:
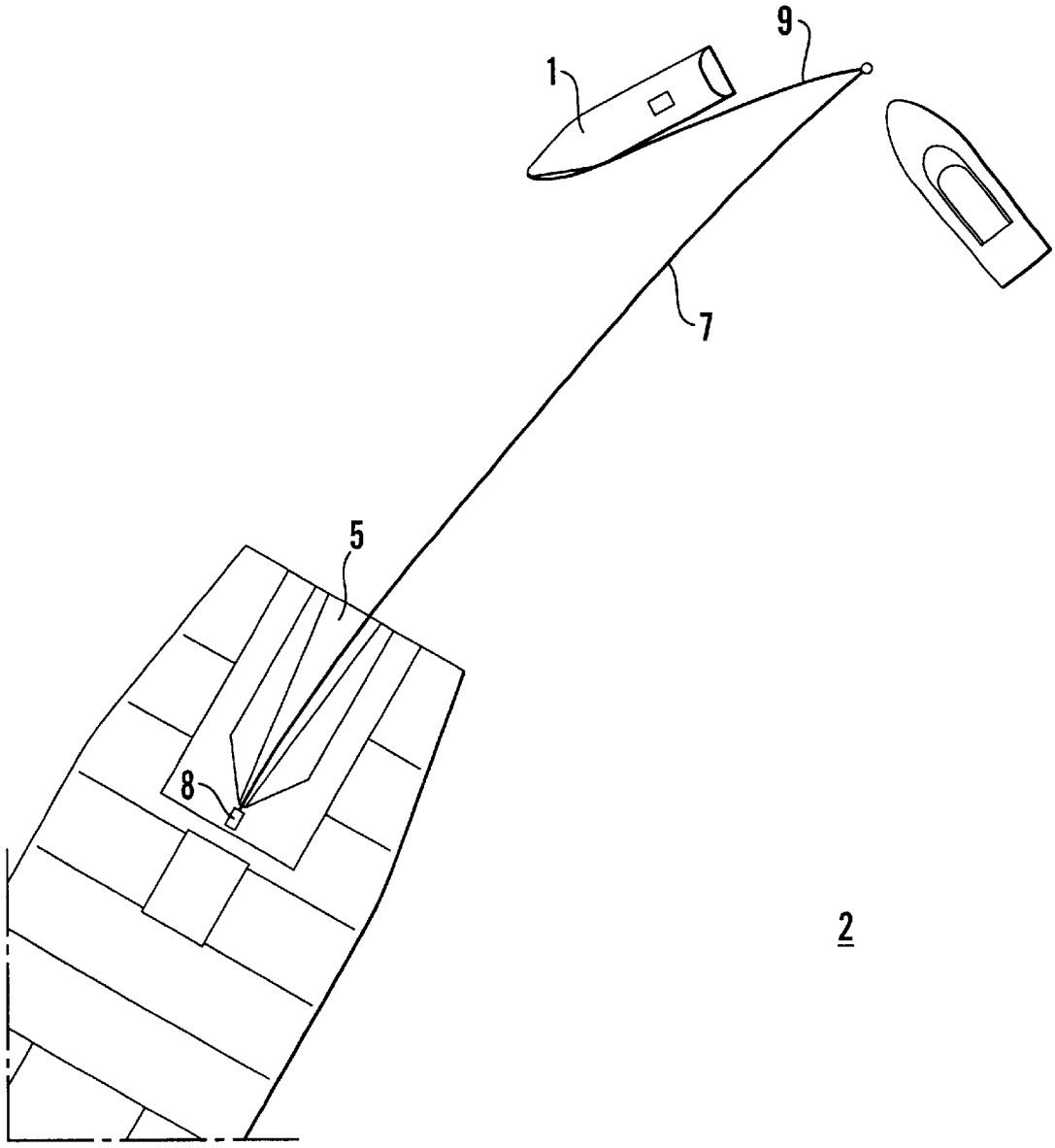

In FIG. 2 the rope 7 is attached to the a life boat 1 by being attached to rope 9 from the life boat. This attachment can be done by personnel on the rescue craft 4 after the rope 9 has been picked up from the sea, which can be done e.g. by a rope with a hook. To facilitate the hooking of rope 9, the end of rope 9 may be provided with a float (not illustrated). If no rope is attached to the life boat, rope 7 may be attached directly to the life boat, which maybe possible if the weather is not too bad.

Figure 3:
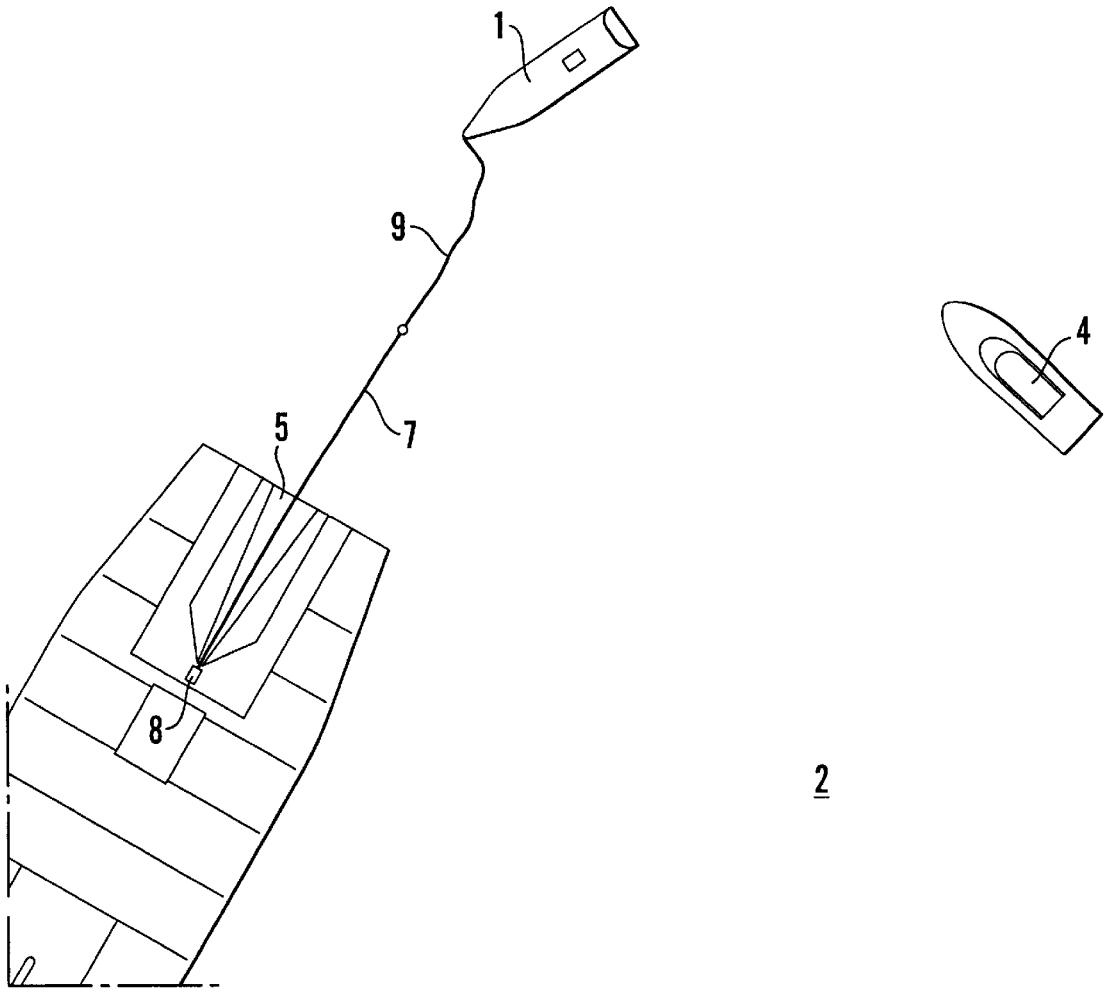

In FIG. 3 the rescue craft 4 has moved away to give room for the life boat, and the winch 8 has started pulling in the ropes 7 and 9.

Figure 4:
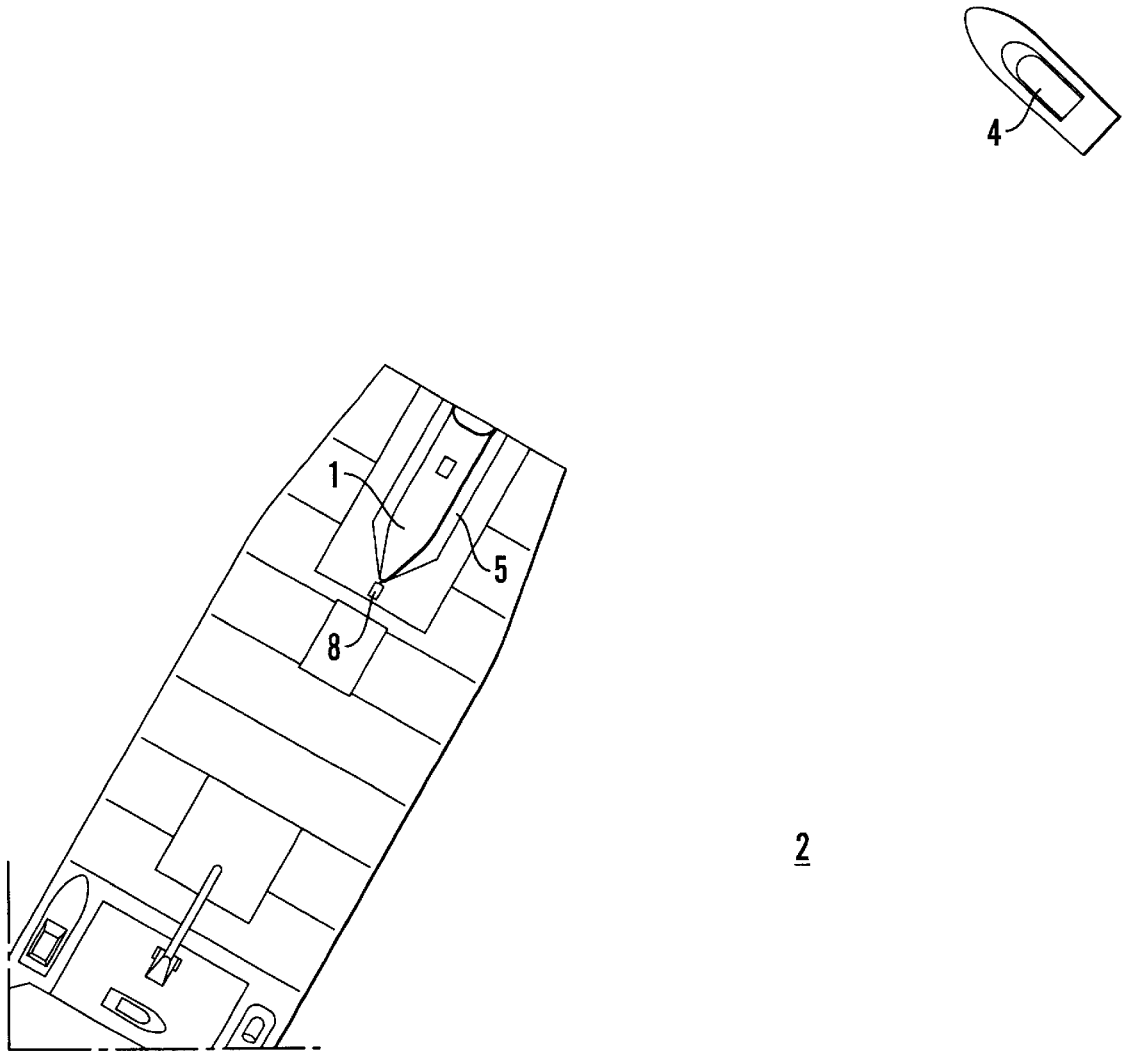

In FIG. 4 the life boat 1 is hauled onto the ramp 5 by the winch 8. The life boat 1 is then emptied.

Thus the task of bringing the people in the life boat 1 aboard the support vessel 3 is completed.

Figure 5:
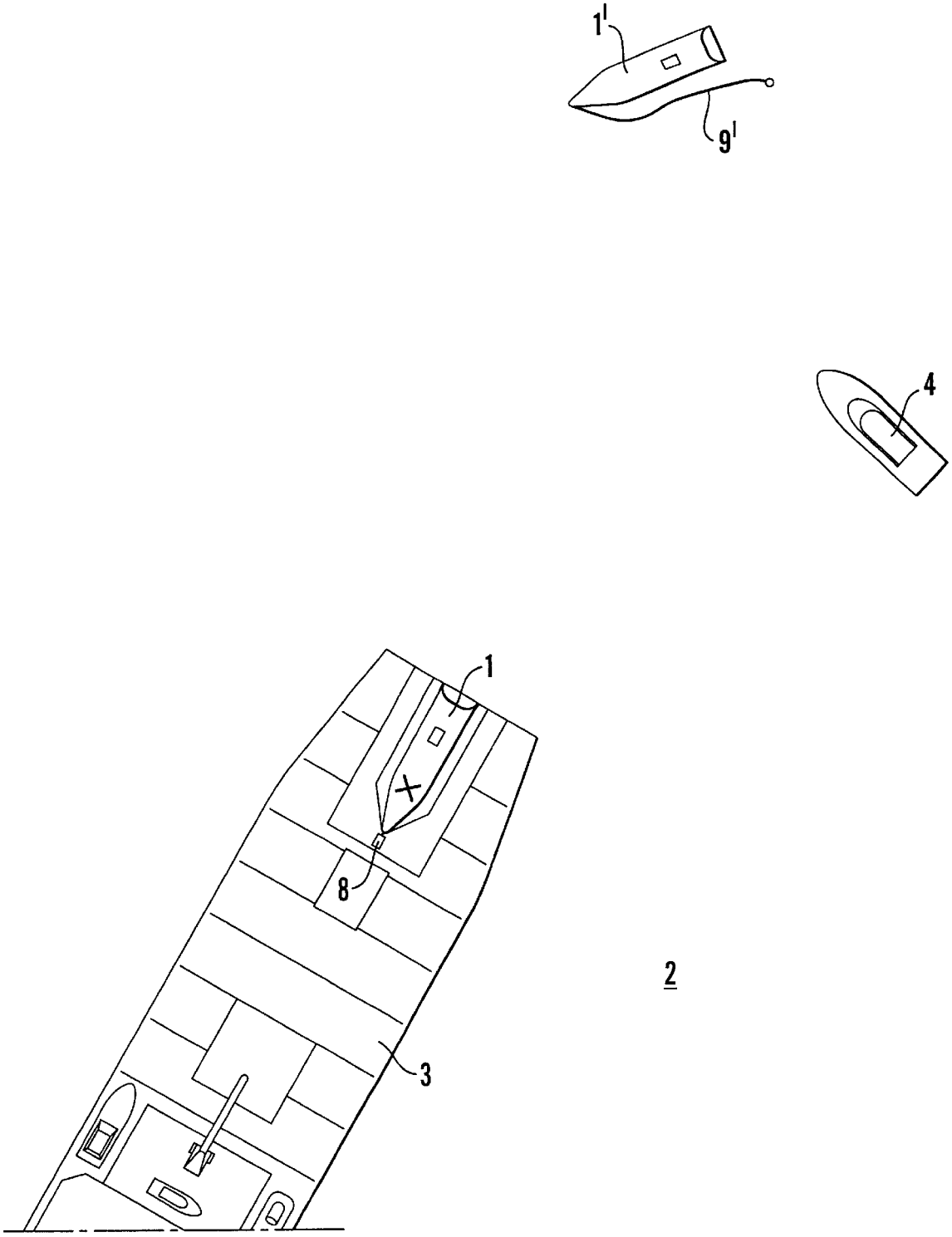
Figure 6:
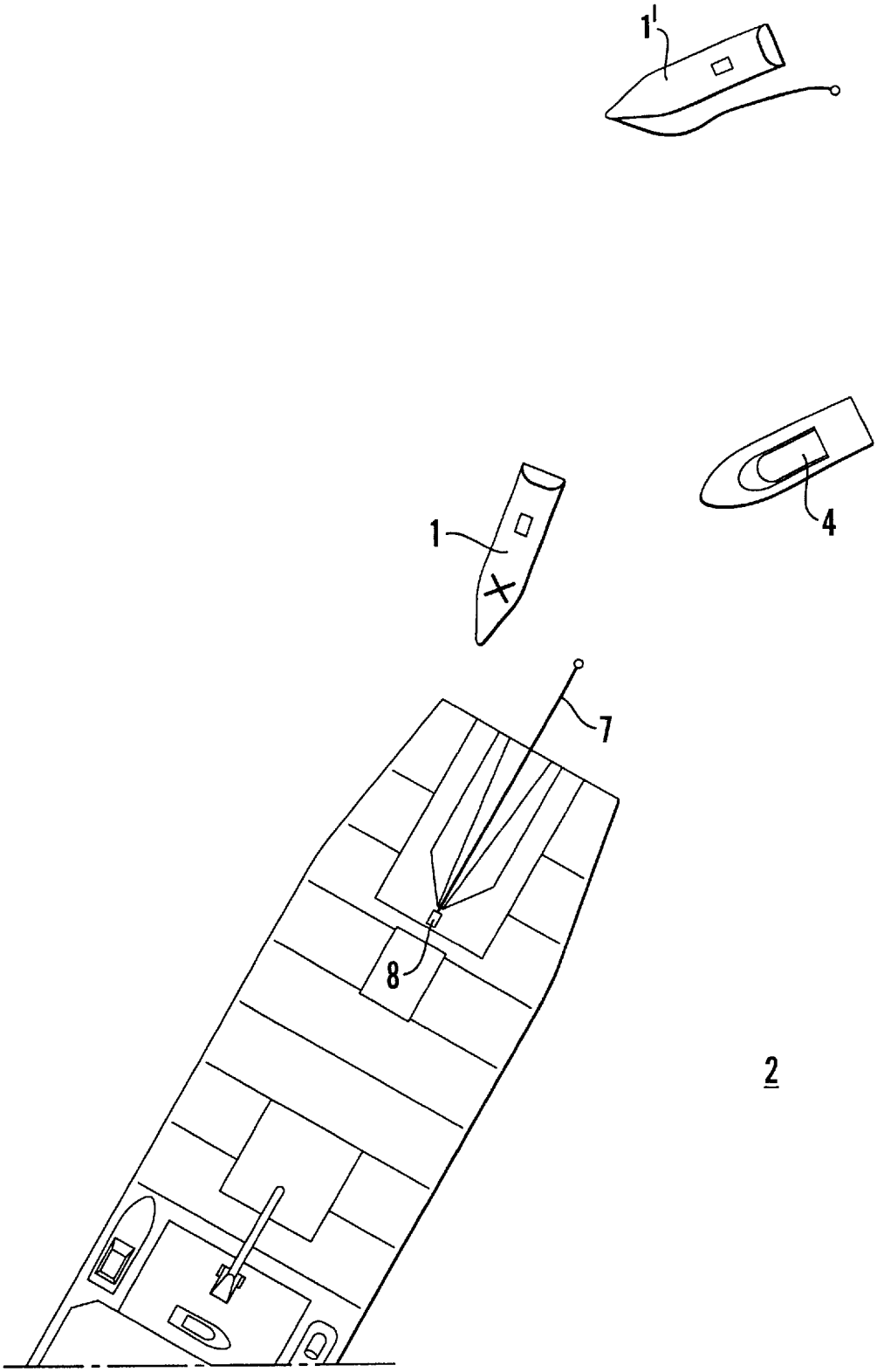

When people from more than one life boat is to be brought aboard the support vessel, the empty life boat 1 is marked, as illustrated in FIG. 5, in which a large X which is easily visible is fixed to the life boat 1. Other types of marks, e.g. flags, can be used. The empty life boat 1 is then returned to the sea, as illustrated in FIG. 6. The rope 7 from the winch 8 is released from the empty life boat 1 and picked up by the rescue craft 4, as illustrated in FIG. 7.

Figure 7:
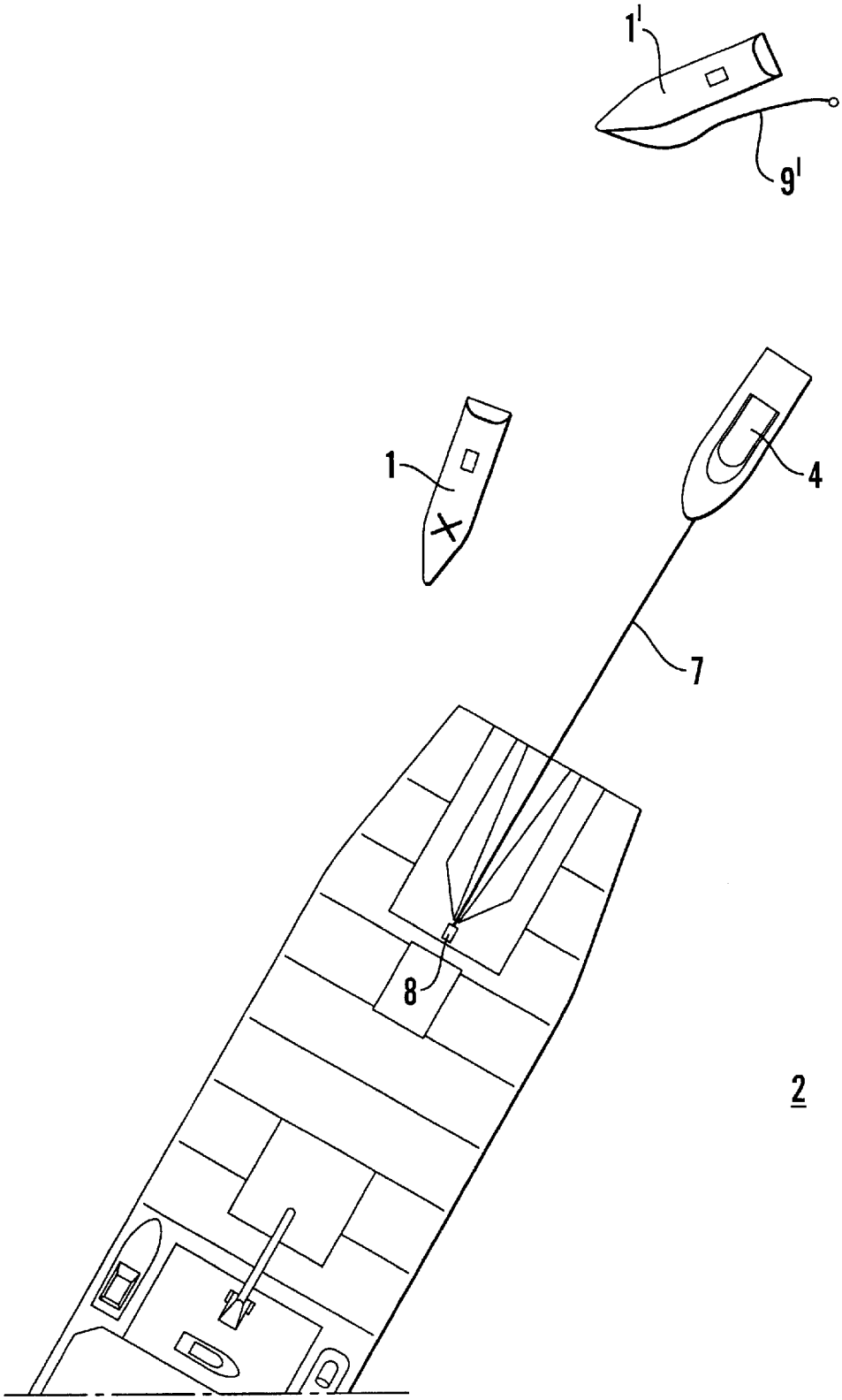

Another life boat 1' is waiting in the sea, as illustrated in FIG. 5, 6 and 7. The purpose of the mark which has been placed on the empty life boat 1, is to ensure that an empty life boat is not mistaken as a life boat with people.

Figure 8:
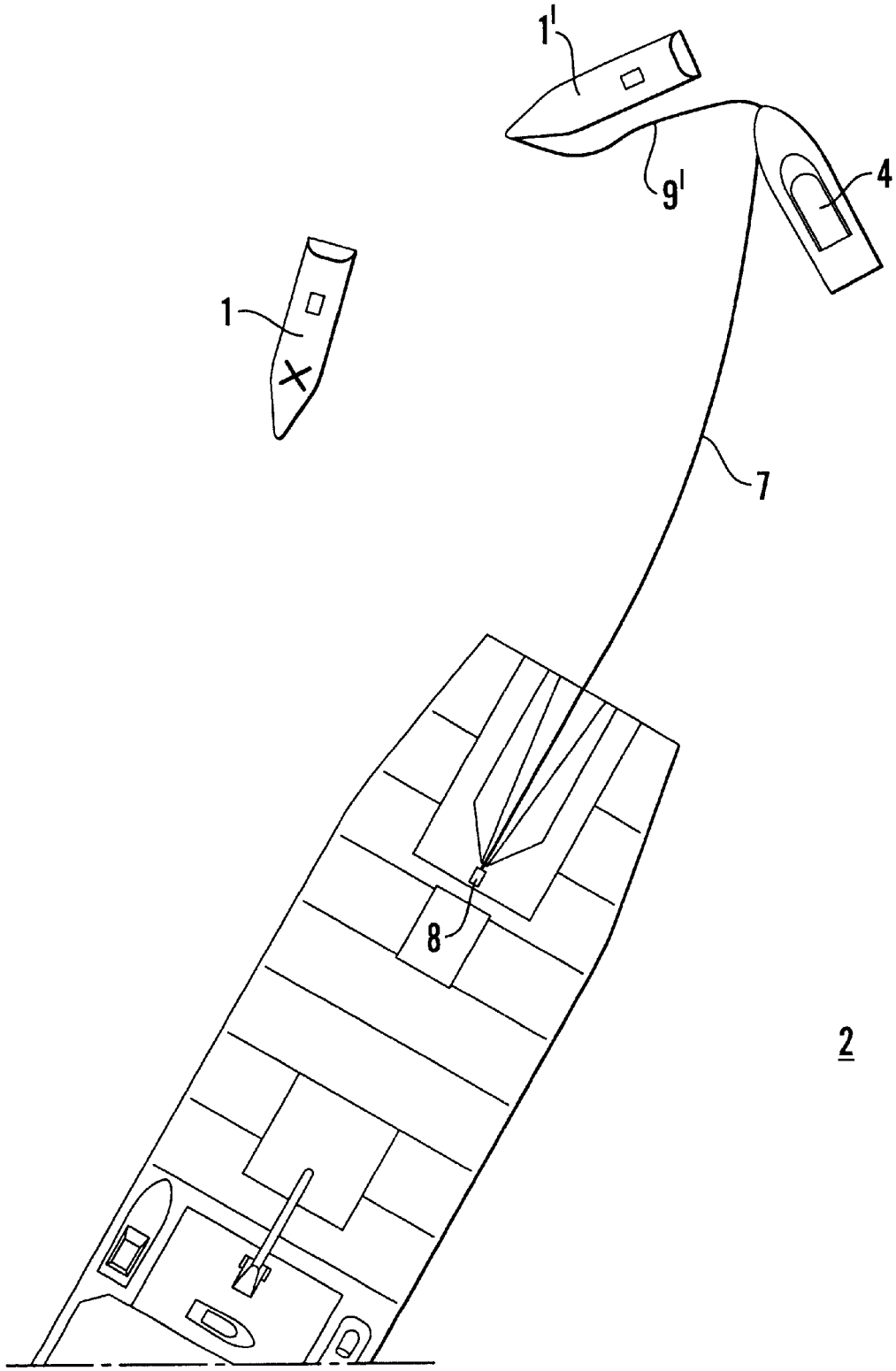

In FIG. 8 the rope 7 is attached to a rope 9' from the life boat 1', and the steps in which the life boat 1 was brought onto the ramp 5 and emptied, is repeated for the life boat 1'. The procedure is repeated until all life boats are emptied.

The ramp preferably constitutes a part of an enclosable reception area in the vessel 3, which will be described later. In heavy sea, waves will normally hit the ramp, and sea water may more or less fill the reception area, and lift the life boat up from the ramp. In order to prevent the life boat of the people leaving the life boat from being smashed against the roof or deck above the reception area, a deck hatch 44 (see FIGS. 10–13) above the ramp 5 is preferably opened prior to the life boat 1 enters the ramp 5.

Another use of the rescue craft 4, which is not illustrated, is to rescue people in the sea. The rescue craft is then launched from the ramp 5 without bringing the rope 7 from the winch 8. After having rescued the people in the sea, which will be done by a net or a ladder in a conventional manner, the rescue craft 4 returns to the support vessel 3 and enters the ramp 5, where the rescued people are taken care of.

The support vessel according to the invention will now be explained with reference to FIGS. 9–13.

Figure 9:
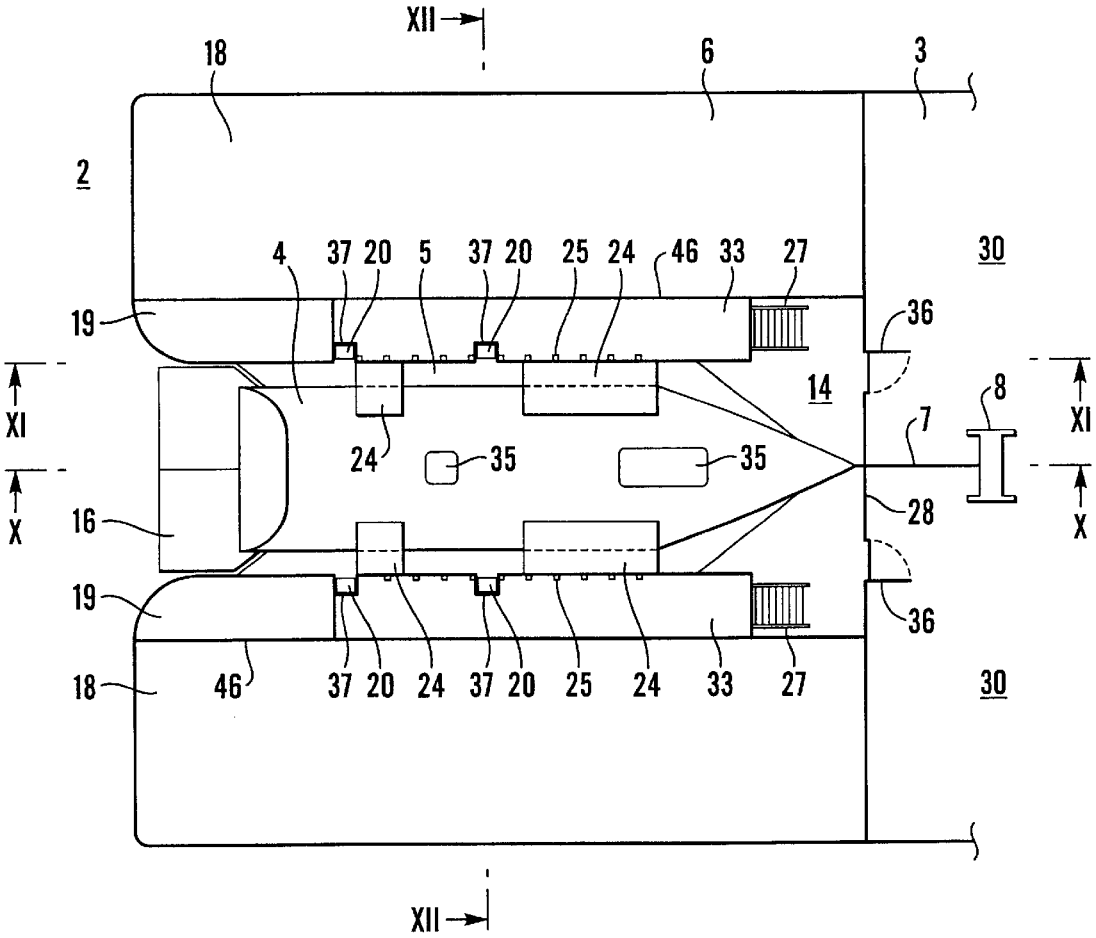
FIG. 9 is a plan view of the stern of a support vessel according to the invention.
Figure 10:
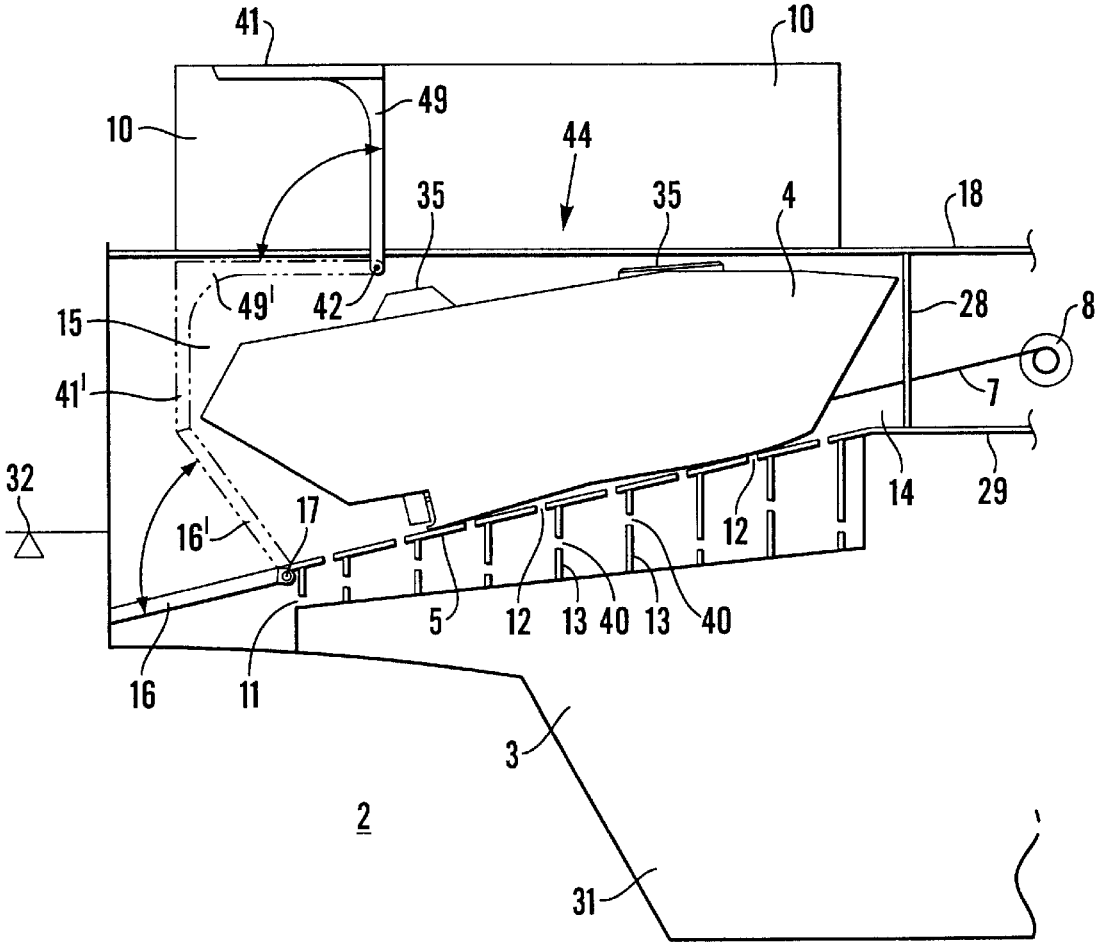
FIG. 10 is a longitudinal section of the stern of the support vessel with a rescue craft on a ramp, taken along line X—X in FIG. 9.
Figure 11:
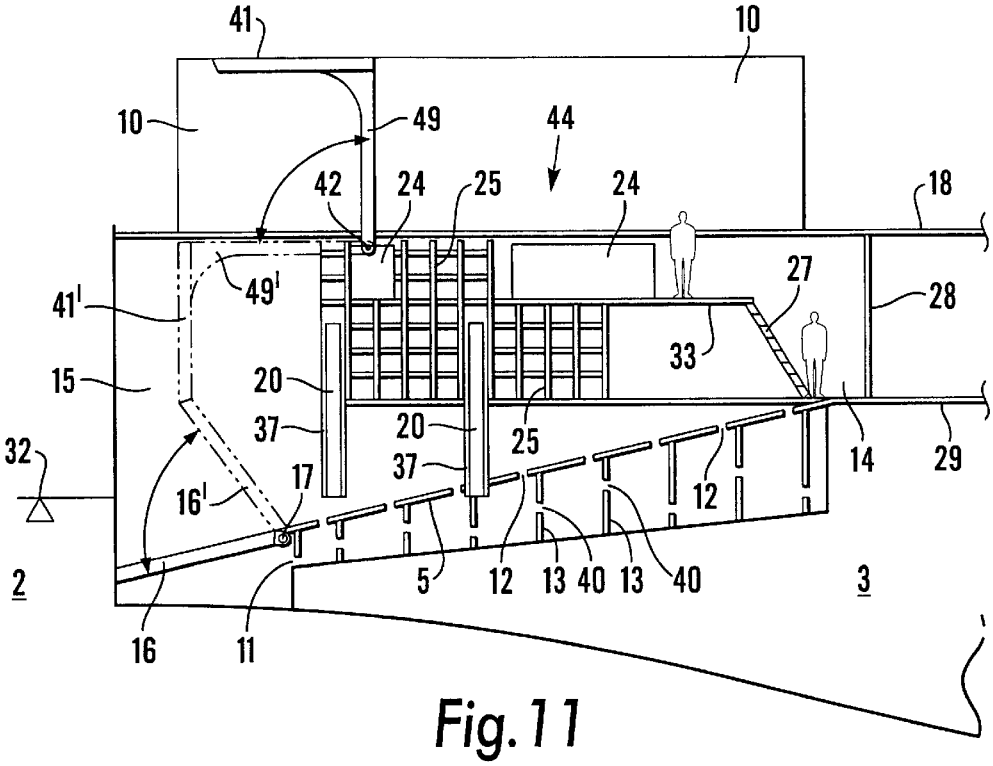
FIG. 11 is a longitudinal section of the stern of the support vessel, taken along line XI—XI in FIG. 9.

FIG. 9 is a plan view of the stern 6 of a support vessel 3 according to the invention, lying in the sea 2, while FIG. 10 and 11 are longitudinal sections taken along line X—X and XI—XI in FIG. 9 respectively. In FIGS. 9 and 10 a rescue craft 4 is seen on the ramp 5, with the bow pointing towards a winch 8 in front of the ramp 5. In FIG. 11 this rescue craft is not visible, as the rescue craft is in front of the section line XI—XI. In order not to overload FIG. 10, some outfit which is visible in FIG. 10 is left out from FIG. 11. Further, which will be understood from a comparison of FIGS. 10, 11 and 12, and the location of the section lines X—X and XI—XI, FIG. 11 does not show the keel 31, which is of no importance to the invention.

The ramp 5 slopes astern and is open towards the sea 2. The sea surface is illustrated by 32, and it is understood that in calm weather the lower portion of the ramp will be under water, while in heavy sea the ramp 5, at least its lower portion, will alternate between being above and below the sea.

When entering the ramp 5, the rescue craft 4 can use its own engine, it can be hauled in by the rope 7 from the winch 8, or a combination of both can be used. The rescue craft is preferably water jet driven as this provides a good manouverabilty in heavy sea. Further a water jet has few vulnerable external parts, and entering the ramp 5 can thus be done without any risk of damage.

The rescue craft 4 is launched by giving out or detaching the rope 7, and activating or releasing not illustrated rollers which are located underneath the rescue craft, whereupon the rescue craft slides or rolls to the sea These rollers are of a conventional design.

Life boats enters the ramp 5 and are launched in the same way as the rescue craft. A life boat, however, has a much smaller engine, and entering is reliable upon the winch 8.

The ramp 5 constitutes a part of an enclosed reception area 14, which is defined by the ramp 5, bulkheads 46 on the side of the reception area 14, a bulkhead 28 in front of the reception area, and a stern deck 18 above the reception area. The ramp 5, the bulkheads 46 and the stern deck 18 define an entrance hatch 15 towards the sea for the launching and entering of the rescue crafts 4 and life boats 1, 1'.

The entrance hatch 15 can be closed by a lower hatch cover which in its front is hinged to the support vessel 3 in hinges 17, which are placed underneath the entrance hatch 15, on the side of the ramp 5. Hydraulic cylinders (not illustrated) enables moving the lower hatch cover between a raised position 16' in which it closes a lower part of the entrance hatch 15 and a lowered position 16 in which it forms an extension of the ramp 5 in the sea 2. The arrangement of the lower hatch cover is very favourable, as it in the open position forms an extension of the ramp 5, which facilitates the entering and launching of the rescue crafts and the life boats, while in the closed position of the lower hatch cover this extension of the ramp is removed, which improves the behaviour of the support vessel in the sea.

Upper hatch covers are illustrated in a raised, open position 41. The upper hatch covers are supported by arms 49 which are hinged to the support vessel 3 by hinges 42 above the entrance hatch 15. Hydraulic cylinders enables movement of the upper hatch covers and the arms into a lowered position 41', 49', in which the upper hatch covers close an upper part of the entrance hatch 15.

A deck hatch 44 and corresponding deck hatch covers 10 in the stern deck 18 will be discussed with reference to FIG. 12.

Sealings, not illustrated, ensures that the entrance area can be totally closed against the sea and thus be kept dry and warm when the hatch covers are closed, in order to store the rescue craft in a non-corrosive, non-icy environment in which it is always ready for use.

A rounded fender portion 19 on each side of the ramp 5 facilitate the entering of the rescue crafts 4 and the life boats 1, 1'. In the illustrated support vessel, the rounded portions 19 are located astern the ramp 5. It should be understood that design modifications in which the ramp extend into the sea is within the scope of the invention, and in this case the rounded portions would be located besides the ramp.

When the entrance hatch 15 is open, waves will enter the ramp 5, which is undesirable. In order to dampen the waves, and remove the sea water, the ramp 5 is perforated by perforations 12. Further, in order to dampen motion of the sea water underneath the ramp 5, the ramp is supported by vertical baffles 13 which extend transverse to the support vessel's 4 longitudinal direction and which have perforations 40 for the sea water. As can be seen from FIG. 10, the foundation for the vertical baffles 13 is sloping astern towards the sea, and sea water that flows up the ramp 5 due to the wave motion will then flow through the perforations 12 in the ramp and fairly smooth flow through the perforations 40 in the baffles 13, whereupon the sea water leaves the vessel 3 through a water outlet 11.

Protection frames 25 besides the ramp 5 protects the rescue craft or life boat in lateral direction. The rescue craft or the Life boat will be held in place by locking arms 20 on each side of the ramp 5. When not in use, the locking arms 20 are kept behind the protection frames 25 in locking arm recesses 37. Hinged gangways 24 enables access from hatches 35 of the rescue craft or life boat to platforms 33 in the reception area 14. Stairs 27 lead from the platforms 33 to the reception deck 29, and doors 36 lead from the reception area 14 to reception rooms 30.

Figure 12:
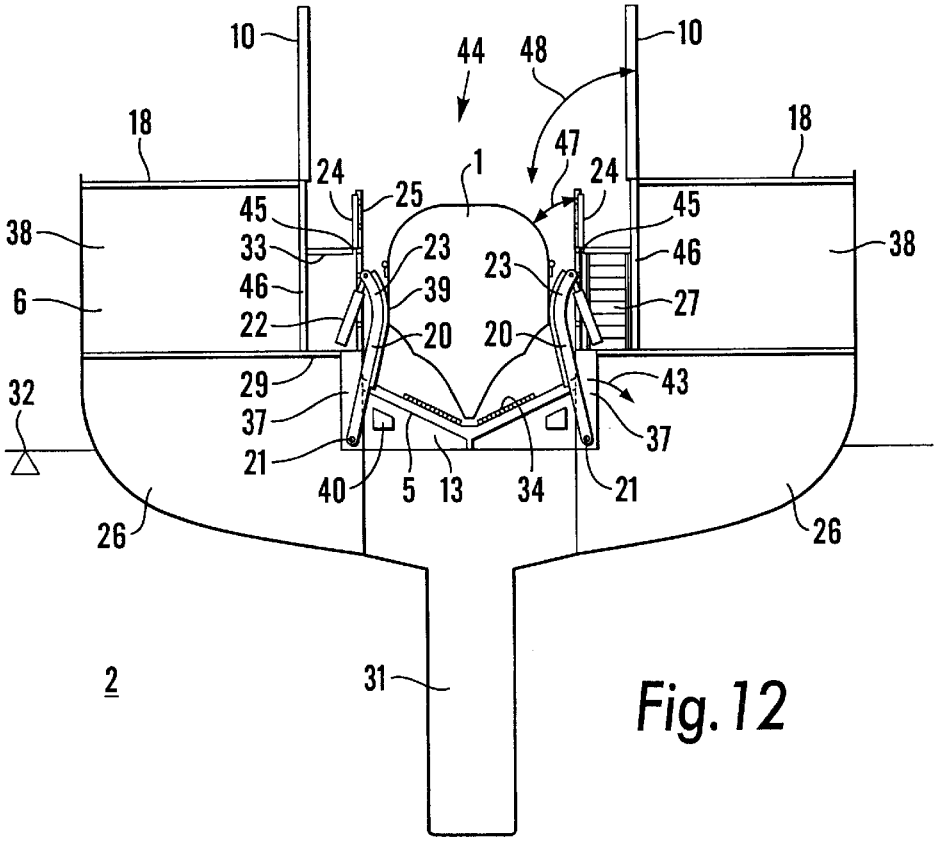
FIG. 12 is a cross section of the stern of the support vessel with a life boat on the ramp, taken along line XII—XII in FIG. 9.
Figure 13:
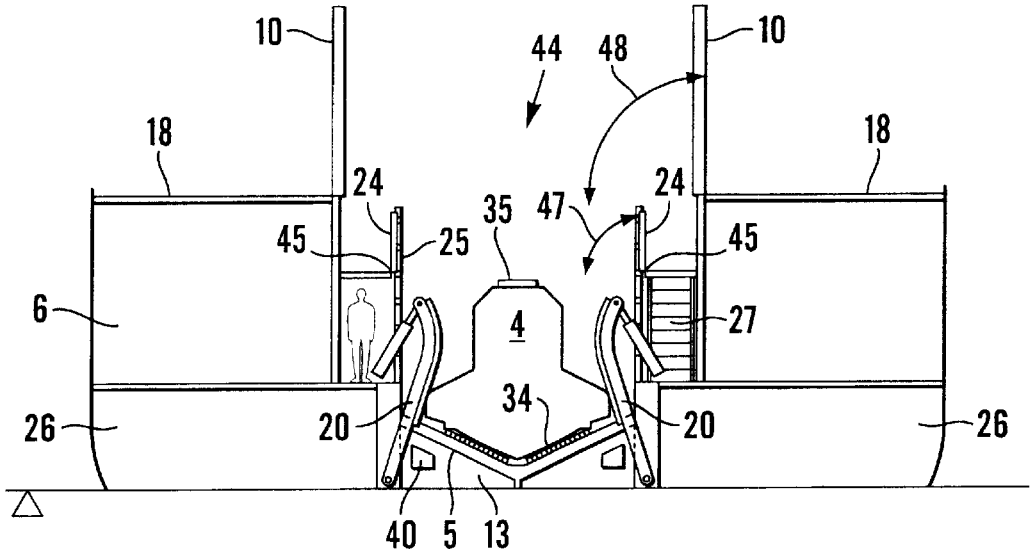
FIG. 13 is a cross section of the stern of the support vessel with a rescue craft on the ramp, taken along line XII—XII in FIG. 9.

FIG. 12 is a cross section of the stern 6 of the support vessel 3 with a life boat 1 on the ramp 5, taken along line XII—XII in FIG. 9, while FIG. 13 similarly illustrates the rescue craft 4 on the ramp, illustrating items above the sea surface only. Utility rooms 38 and wing tanks 26 are of conventional type, and does not take part of the invention.

The ramp 5 has a V-shape for supporting the rescue crafts and the life boats. The ramp is designed to match the rescue craft 4. The life boat 1 has a different shape, and as life boats are of various designs, no particular V-shape that fits all life boats can be made. FIGS. 12 and 13 illustrates the function of the locking arms 20. Hinges 21 in lower ends and hydraulic cylinders 22 enables a controlled motion of the upper ends of the locking arms from positions completely within the recesses 37 to positions in which the locking arms extend into the area above the ramp 5. The upper ends have convex portions 23 pointing towards the life boat 1 or rescue craft 4. The movability of the locking arms, as well as the convex portions 23 enables holding life boats with different shapes in place. Other locking arm arrangements are conceivable, e.g. two or six locking arms.

The ramp 5 and the locking arms 20 have rubber protections 34 and 39 respectively.

Hinges 45 allow the gangways 24 to be rotated from the positions illustrated in FIGS. 12 and 13 to positions in which they abut the life boat 1 or rescue craft 4, as illustrated by arrow 47, and thus form adaptable access ways to and from the life boat 1 or rescue craft 4.

In heavy sea waves will normally hit the ramp, and sea water may more or less fill the ramp 5 and the reception area 14. In such conditions, the entering of the rescue craft or the life boat onto the ramp will involve rough movements. In order to prevent the rescue craft, life boat or people leaving the life boat from smashing against the stem deck 18 above the ramp 5 due to vertical movements during the entering, the stem deck 18 is provided with a deck hatch 44 which can be closed by deck hatch covers 10, as illustrated by arrow 48. FIGS. 10–13 all illustrate the deck hatch covers 10 in open position.

Figure 14:
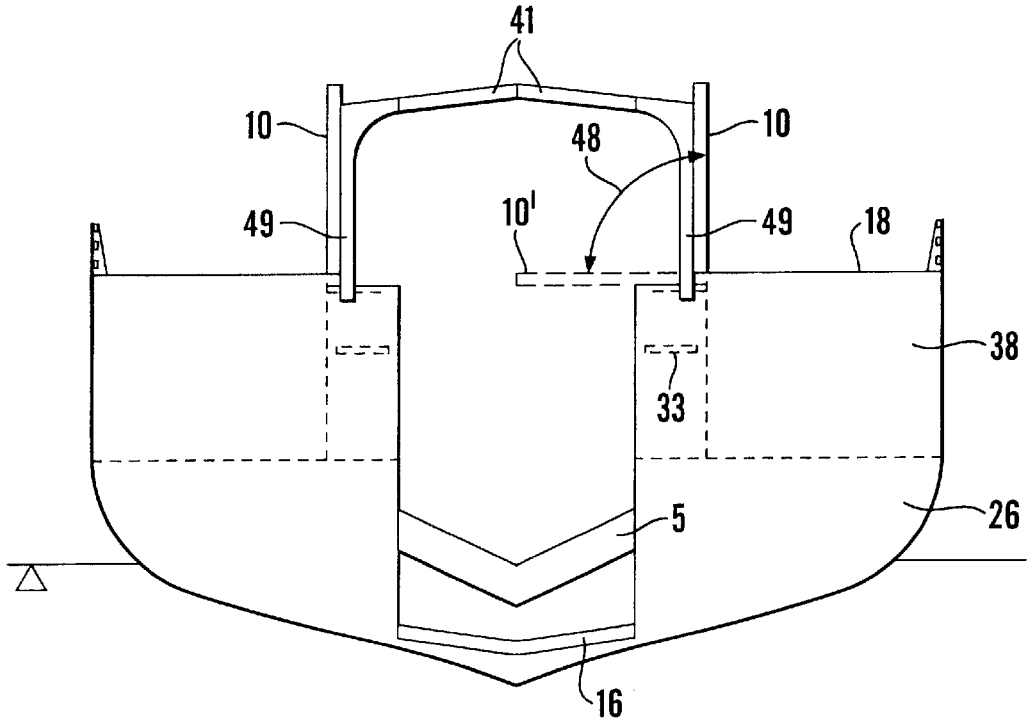
FIG. 14 is a rear view of the support vessel with open hatches and empty ramp.

FIG. 14 is a rear view of the support vessel with open hatches and empty ramp, and illustrates the location of the arms 49, outside an area above the ramp 5, i e. on the sides of the ramp 5. The arms 49 and the upper hatch covers 41 are illustrated in the raised position, in which the upper hatch covers are elevated above the entrance hatch by the length of the arms 49, providing a free space above the ramp 5. Thus there is provided an open space for the rescue craft and life boats above the ramp 5, which facilitates the entering and reduces the risk for the rescue craft or life boat hitting the upper hatch cover 41 in heavy sea.

FIG. 14 also illustrates one of the deck hatch covers in a closed position 10', in which the deck hatch cover forms a part of the deck 18. In the closed position the deck hatch covers cover the deck hatch 44 as well as the arms 49.

What is claimed is:

1. A method for bringing people in life boats in the sea aboard a support vessel, said method comprising the following steps:

a) launching a rescue craft from a ramp in the stern of the support vessel, the rescue craft carrying a rope from a winch in front of the ramp, b) attaching the rope to a life boat in the sea, c) hauling the life boat onto the ramp by the winch, and emptying the life boat, d) marking and launching the empty life boat to the sea, e) releasing the rope from the winch from the empty life boat and picked up by the rescue craft, and f) repeating step b) and c) for another life boat.

2. The method according to claim 1, wherein the rope from the winch is attached to a rope from the life boat during step b).

3. The method according to claim 1, wherein a deck hatch above the ramp is opened prior to step c).

4. A support vessel for launching and recovery of rescue crafts and life boats, said support vessel comprising a stern ramp for launching and entering of rescue crafts and life boats, a winch for hauling the rescue crafts and life boats onto the ramp, a closable deck hatch above the ramp, at least one corresponding deck hatch cover, and at lest one locking arm on each side of the ramp for holding the rescue craft or the life boat in place.

5. The support vessel according to claim 4, wherein the ramp is sloping astern towards the sea.

6. The support vessel according to claim 4, wherein the ramp has a V-shape for supporting the rescue crafts and the life boats.

7. The support vessel according to claim 4, wherein the ramp is perforated, to dampen waves of the sea and is supported by vertical, perforated baffles extending transverse to the support vessel's longitudinal direction, to dampen motion of the sea underneath the ramp.

8. The support vessel according to claim 4, wherein the ramp constitutes a part of an enclosable reception are.

9. The support vessel according to claim 4, further comprising a closable entrance hatch for the ramp.

10. The support vessel according to claim 9, further comprising at least one hatch cover which in a front is hinged to the support vessel underneath the entrance hatch, the hatch cover in a raised position closes at least a part of the entrance hatch and in a lowered position forms an extension of the ramp in the sea.

11. The support vessel according to claim 9, further comprising hatch covers which are supported by arms which are hinged to the support vessel above the entrance hatch, the arms being located outside an area above the ramp, the hatch covers, in a lowered position, closes at least a part of the entrance hatch and in a raised position is elevated above the entrance hatch by the length of the arms, providing a free space above the ramp.

12. The support vessel according to claim 4, further comprising a rounded fender portion on each side of the ramp, besides or astern the ramp, to facilitate the entering of the rescue crafts and the life boats.

13. The support vessel according to claim 4, wherein the locking arm being hinged in a lower end and in an upper movable end having a convex portion pointing towards the rescue craft or life boat, for adaption to different life boat shapes.

14. The support vessel according to claim 4, further comprising at least one hinged gangway for access to and from the rescue craft and the life boat.

15. A method for bringing people in life boats in the sea aboard a support vessel, said method comprising the following steps:

a) launching a rescue craft from a ramp in the stern of the support vessel, the rescue craft carrying a rope from a winch in front of the ramp, b) attaching the rope to a life boat in the sea, c) opening a deck hatch above the ramp, and d) hauling the life boat onto the ramp by the winch, and emptying the life boat.

16. A support vessel for launching and recovery of rescue crafts and life boats, said support vessel comprising a stern ramp for launching and entering of rescue crafts and life boats, a winch for hauling the rescue crafts and life boats onto the ramp, a closable deck hatch above the ramp, at least one corresponding deck hatch cover, the ramp being perforated, to dampen waves of the sea, and being supported by vertical, perforated baffles extending transverse to the support vessel's longitudinal direction, to dampen motion of the sea underneath the ramp.

17. A support vessel for launching and recovery of rescue crafts and life boats, said support vessel comprising a stern ramp for launching and entering of rescue crafts and life boats, a winch for hauling the rescue crafts and life boats onto the ramp, a closable deck hatch above the ramp, at least one corresponding deck hatch cover, a closable entrance hatch for the ramp, and hatch covers supported by arms hinged to the support vessel above the entrance hatch, the arms being located outside an area above the ramp, the hatch covers, in a lowered position, closes at least a part of the entrance hatch and in a raised position elevated above the entrance hatch by the length of the arms, providing a free space above the ramp.

* * * * *